US006841927B2

(12) United States Patent
Lee

(10) Patent No.: US 6,841,927 B2
(45) Date of Patent: Jan. 11, 2005

(54) COLOR CATHODE RAY TUBE

(75) Inventor: Tae Hoon Lee, Kumi-shi (KR)

(73) Assignee: LG. Philips Displays Korea Co., LTD, Kyongsangbuk-do (KR)

( * ) Notice: Subject to any disclaimer, the term of this patent is extended or adjusted under 35 U.S.C. 154(b) by 70 days.

(21) Appl. No.: 10/138,378

(22) Filed: May 6, 2002

(65) Prior Publication Data

US 2003/0122474 A1 Jul. 3, 2003

(30) Foreign Application Priority Data

Jan. 3, 2002 (KR) ..... P2002-287

(51) Int. Cl.[7] ..... H01J 31/00
(52) U.S. Cl. ..... 313/474; 313/408
(58) Field of Search ..... 313/474, 461, 313/463, 466, 477 R, 478, 479, 408, 402; 220/2.1 R, 2.1 A, 2.3 A, 2.3 R

(56) References Cited

U.S. PATENT DOCUMENTS 6,025,676 A 2/2000 Ohama et al.
6,232,712 B1 5/2001 Pyun et al.
6,388,373 B1 * 5/2002 Nah ..... 313/474

* cited by examiner

*Primary Examiner*—Nimeshkumar D. Patel
*Assistant Examiner*—Ken A Berck
(74) *Attorney, Agent, or Firm*—Birch, Stewart, Kolasch & Birch, LLP

(57) ABSTRACT

A color cathode ray tube capable of improving the luminance attenuation characteristic and the explosion-proof characteristic through an improved shape of a panel is disclosed. In an equation F=Rdo/(Sd H 1.767), F>21, Tc/CFT≦1.35, and Rdi>(Ryi or Rxi) are satisfied, wherein Sd is a length of a diagonal effective picture of the panel, Rdo is a curvature radius of a diagonal outer surface, Ryo is a curvature radius of a vertical outer surface, Rxi, Ryi and Rdi are a horizontal, vertically and diagonal curvature radius, respectively, CFT is a thickness of a center portion, Tc is a thickness of a diagonal end of the effective surface, F is a planarizing rate of the outer curvature.

7 Claims, 7 Drawing Sheets

COLOR CATHODE RAY TUBE

This application claims the benefit of the Korean Application No. P2002-00287 filed on Jan. 3, 2002, which is hereby incorporated by reference.

BACKGROUND OF THE INVENTION

1. Field of the Invention

The present invention relates to a color cathode ray tube, and more particularly, to a color cathode ray tube capable of improving characteristics of luminance attenuation and explosion-proof through improvement of a shape of a panel.

2. Discussion of the Related Art

The structure of a general mask stretching-type color cathode ray tube is shown in FIG. 1.

Referring to FIG. 1, a vacuum envelope consisting of a rectangular panel 20 located on its front surface, a funnel 12 located on a rear surface of the panel 20, and a neck 6 extended from a rear end of the funnel 12 is sealed in a high vacuum pressure of about $10^{-7}$ Torr to secure smooth interlaced scanning of electron beams therein. An electron gun 8 is provided in the neck 6 to emit the electron beams 2 of red, green, and blue. A three-color (red, green, and blue) phosphor screen 16 and a color selection tension mask 18 are stretched in a vertical direction with respect to the cathode ray tube on an inner surface of the panel by a frame 15. The electron beams emitted from the electron gun 8 are controlled by a deflection yoke 4, and then are emitted onto a phosphor screen 16 to form an image.

According to the assembled structure of the tension mask 18 and the frame 15, as shown in FIG. 2, the tension mask 18 with electron beam passing apertures 18*a* of a grill or stripe type is welded at both ends of a long side to the frame 15, and is applied with tension in a direction parallel to the grill, i.e., vertical direction, by compression reacting force of the frame 15. The tension mask 18 is formed in a shape of straight line when viewing from a vertical direction, while the tension mask has a desired radius of a curvature, Rm, to have a convex shape with respect to an axis of a cathode ray tube, similar to an inner curvature of the panel 20, when viewing from a horizontal direction. The electron beam passing apertures 18*a* formed on the tension mask 18 have a desired pitch in a horizontal direction.

The panel 20 attached to the front surface of the vacuum envelope 1, the inside of which is maintained in a vacuum condition to secure smooth interlaced scanning of electron beams, is shown in FIGS. 3*a* and 3*b*.

The panel 20 having a generally rectangular shape includes an effective surface 22 on which the phosphor screen 16 is formed, a long side 24 formed in a horizontal direction at both ends of a vertical axis, a short side 26 formed in a vertical direction at both ends of a horizontal axis, and a corner 28 forming both ends of a diagonal axis. The sides and corner are bent toward a rear of the tube axis from an edge of the effective surface to form a skirt 29.

FIG. 4 shows a shape of the effective surface 22. A curvature radius of an outer surface, Ro, of the effective surface seems to be a flat surface when viewing visually, while a curvature radius of an inner surface thereof is formed in a non-spherical shape. Specifically, the curvature radius of the inner surface may be represented by three curvatures, i.e., a vertical inner curvature radius Riv, a horizontal inner curvature radius Rih, and a diagonal inner curvature radius Rid.

The above three curvature radiuses of the panel for the conventional mask stretching-type flat color cathode ray tube is generally manufactured according to a condition of Riv>Rid>Rih, or Riv≅Rid>Rih. In addition, a ratio of Riv/Rid has a range of 1.00 to 1.20, and a ratio of Riv/Rih has a range of 0.36 to 1.5. Wedge amount (a ratio of a thickness of an diagonal end of the effective surface of the panel to a thickness of a center portion of the panel, i.e., Tc/CFT) is in the order of about 1.3.

The inner curvature Ri of the panel for the conventional mask stretching-type flat color cathode ray tube constructed described above is determined as follows:

FIG. 5*a* shows a geometrical relationship of a conventional formed mask-type flat color cathode ray tube, and FIG. 5*b* shows a geometrical relationship between the electron beams and the panel and mask with respect to the conventional mask stretching-type flat color cathode ray tube.

Referring to FIG. 5*a* showing the conventional formed mask-type flat color cathode ray tube, in order to maintain a value of beam arrangement as '1' (the value of the beam arrangement indicates the order of constantly arranging a space to an adjacent electron beam after the electron beam 2 passes through the apertures of the mask 19 and reaches the inner surface of the panel), the geometrical relationship among the inner curvature Ri' of the panel, the curvature Rm of the formed mask, and the electron beam is represented as follows:

$$GR \propto \frac{S \times Q}{Ph \times L}$$

where, GR is beam arrangement between peripheral electron beams, S is a distance between a center electron beam and peripheral electron beams on a deflecting center, Q is a distance between the inner surface of the panel and the mask on a pathway of the electron beam, and Ph is a distance between the passing aperture of the mask and a peripheral passing space at a position to which the electron beam reaches.

In the above relationships, on the basis that the electron beam is emitted onto the center of the panel, the more the electron beam is emitted in a peripheral direction, the more increasing the value L is. Since it is changed in a type of Lo (a distance from the center of the panel)<L' (a distance from the peripheral portion of the panel), the value Q is increased as it goes toward the peripheral portion to maintain a condition of GR=1. Therefore, a condition of Qo (a distance form the center portion of the panel)<Q' (a distance from the peripheral portion of the panel) is necessary. In case of the formed mask-type flat color cathode ray tube, the increase of the value Q required in the peripheral portion can be adapted by transforming the shape of the mask. Accordingly, when determining the inner of curvature of the panel, it is possible of design it, in view of a floating effect of the image according to the thickness of the panel and a mechanical strength under the vacuum state.

The structure of vertical, horizontal, and diagonal curvature is satisfied with the condition of Rid>Rih>RiV, that is favorable for the structure of panel vacuum stress.

According to the mask stretching-type flat color cathode ray tube shown in FIG. 5, each value Q of the center portion and peripheral portion of the panel is under a condition Qo (center portion)>Q' (peripheral portion; 6 and 12-o'clock directions), which is contrary to the results of the formed mask-type flat color cathode ray tube, depending upon a mode of the tension mask 18 the mask of which is vertically stretched every section. Therefore, as it goes toward the peripheral portion (6 and 12-o'clock directions), the value GR is lower than 1. Contrary to the formed mask 19, since the vertical curvature of the tension mask 18 is infinite, there is technical difficulty that it does not meet the variation of the value Q to maintain GR=1.

In the mask stretching-type flat color cathode ray tube, since it does not meet the variation of the value Q using the curvature of the mask, the vertical curvature radius Riv of the panel of FIG. 4 is formed larger than the horizontal curvature radius Rih and the diagonal curvature radius Rid. Specifically, the increase of required value Q is met by increasing the value Riv in a more flat direction. After all, the structure of curvature radius of each axis consists of a condition of Riv>Rid>Rih or Riv≅Rid>Rih.

The value GR required for maintaining the quality of picture optimally has to satisfy a range of 1∀0.03. In case that the structure of the inner curvature radius of the panel of each axis is formed by the structure of Rid>Rih>Riv which is the condition of the formed mask-type flat color cathode ray tube, the value GR is below about 0.80, thereby deteriorating the picture in order of not displaying the basic picture of the cathode ray tube.

The structure of the mask stretching-type flat color cathode ray tube has the structure of Riv>Rid>Rih or Riv≅Rid>Rih. In the structure that the vertical inner curvature is more flat than the horizontal or diagonal curvature, the thickness of the vertical panel glass is thinner than that of the diagonal or horizontal panel glass on the basis of the same wedge amount (a ratio of a thickness of a diagonal end of the effective surface of the panel to a thickness of a center portion of the panel).

The vacuum stress is increased by such the structure when evacuating the vacuum envelope of the cathode ray tube, thereby raising a safety problem. Specifically, in case of evacuating the vacuum envelope 1 consisting of the panel 20 and the funnel 12, strong tension stress is happened at the panel 20, the situation shown in FIG. 6.

FIG. 6 shows distortion of the vacuum envelope when evacuating the vacuum envelope. When evacuating the vacuum envelope, the effective surface 22 of the panel is distorted inwardly on the basis of the center of the panel 20, and the skirt 29 of the panel is distorted outwardly. According to the above distortion, the edge of the effective surface 22 with a flat outer surface is applied with the strong tension stress. The vertical end Ev of the effective surface is applied with the maximum tension stress. According to the structure of the conventional panel, the inner curvature radius is increased to meet the increase of demanded value Q. The reduced vertical thickness of the glass is coupled to the portion from which the maximum tension stress is generated, so that the stress is increased to the extreme extent, thereby causing the explosion-proof characteristic to be reduced and so generating the safety problem.

For example, in case of the mask stretching-type flat color cathode ray tube of 32 voltages, the tension stress of above about 12 Mpa is generated, thereby exceeding a tolerance limit of tension stress, 10 Mpa. In order to solve the problem, the conventional cathode ray tube increases the thickness of the outer surface of the panel by a predetermined degree a, as shown in FIG. 5*b*, to suppress the generation of stress at the effective surface. However, the method increases extremely the thickness of the center portion of the panel in relation to the formed mask-type flat color cathode ray tube.

For example, in case of the formed mask-type flat color cathode ray tube of 32 voltages, the thickness of the center portion of the panel is 15 t, while in case of the mask stretching-type flat color cathode ray tube the thickness of the center portion of the panel is 21.5 t, thereby increasing the thickness of about 43 percentages.

In addition, the increased thickness of the panel causes a light transmittance to be reduced, thereby deteriorating the luminance characteristic. Breakage is increased during an annealing process of the cathode ray tube, and thermal process index is reduced. The increased weight of the panel causes materials and manufacturing costs to be increased.

SUMMARY OF THE INVENTION

Accordingly, the present invention is directed to a color cathode ray tube that substantially obviates one or more problems due to limitations and disadvantages of the related art.

An object of the present invention is to provide a color cathode ray tube capable of improving the luminance attenuation characteristic and the explosion-proof characteristic through an improved shape of a panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a flat color cathode ray tube including a vacuum envelope consisting of a panel, a funnel, and a neck, the panel having a generally flat outer surface and a convex inner surface having a curvature with respect to an axis of the cathode ray tube, the inner surface having an effective surface on which a phosphor screen is formed, a grill or stripe-type mask being opposed to the inner surface of the panel and extended in a vertical direction, wherein in an equation F=Rdo/(Sd H 1.767), conditions of F>21, Tc/CFT<1.35, and Rdi>(Ryi or Rxi) are satisfied, where Sd is a length of a diagonal effective picture of the panel, Rdo is a curvature radius of a diagonal outer surface, Ryo is a curvature radius of a vertical outer surface, Rxi, Ryi and Rdi are a horizontal, vertically and diagonal curvature radius, respectively, CFT is a thickness of a center portion, Tc is a thickness of a diagonal end of the effective surface, F is a planarizing rate of the outer curvature.

Preferably, a relationship of 0.81≦Ryi/Rdi≦0.99 is satisfied between the inner curvature radius of the respective axis.

More preferably, a relationship of 0.99≦Ryi/Rxi≦1.359 is satisfied between the inner curvature radius of the respective axis.

The structure of the inner curvature radius of the panel is satisfied with Rdi>Ryi>Rxi.

A relationship of 0.81≦Ryi/Rdi≦0.99 and 0.99≦Ryi/Rxi≦1.35 is satisfied between the inner curvature radius of the respective axis.

A relationship of 0.81≦Ryi/Rdo≦0.11 is satisfied between the vertical outer curvature radius and the vertical inner curvature radius.

A relationship of 0.82≦Ryi/Rdi≦0.95 is satisfied between the vertical inner curvature radius Ryi and the diagonal inner curvature radius Rdi, or a relationship of 1.00≦Ryi/Rxi≦1.30 is satisfied between the vertical inner curvature radius Ryi and the horizontal inner curvature radius Rxi.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
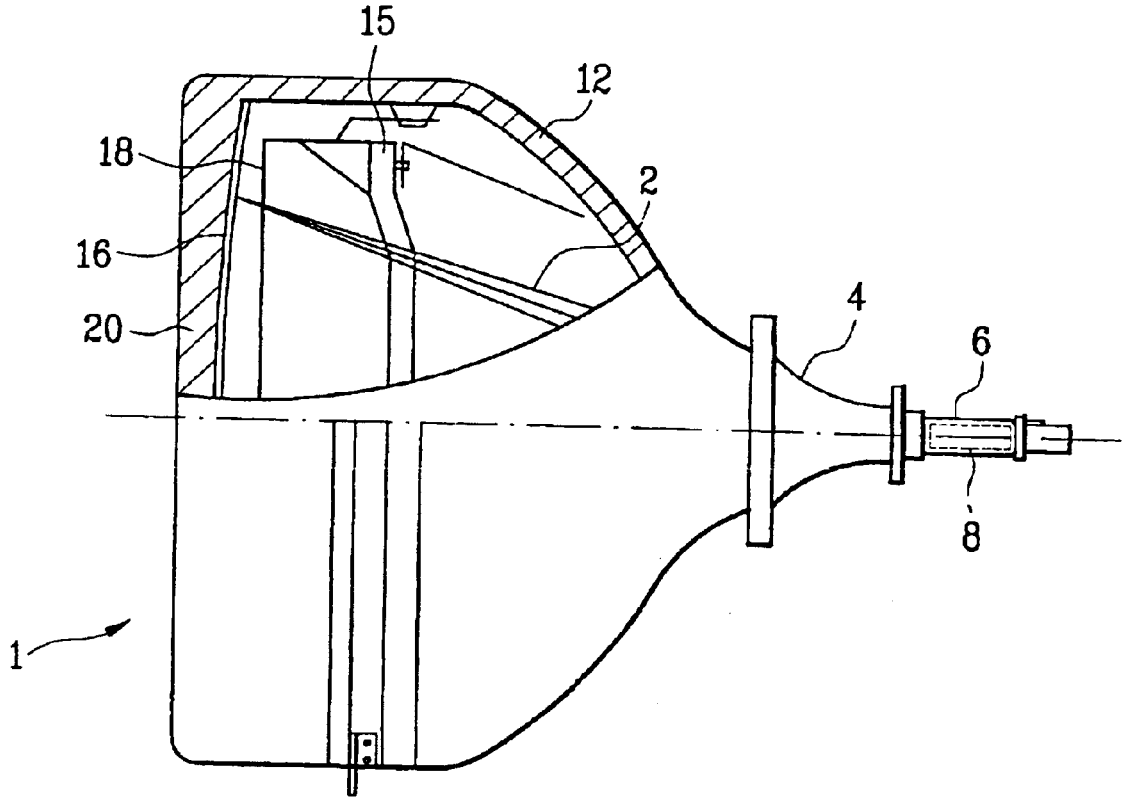
FIG.1 Related Art
FIG. 1 is a perspective view illustrating the construction of a conventional flat color cathode ray tube.
Figure 2:
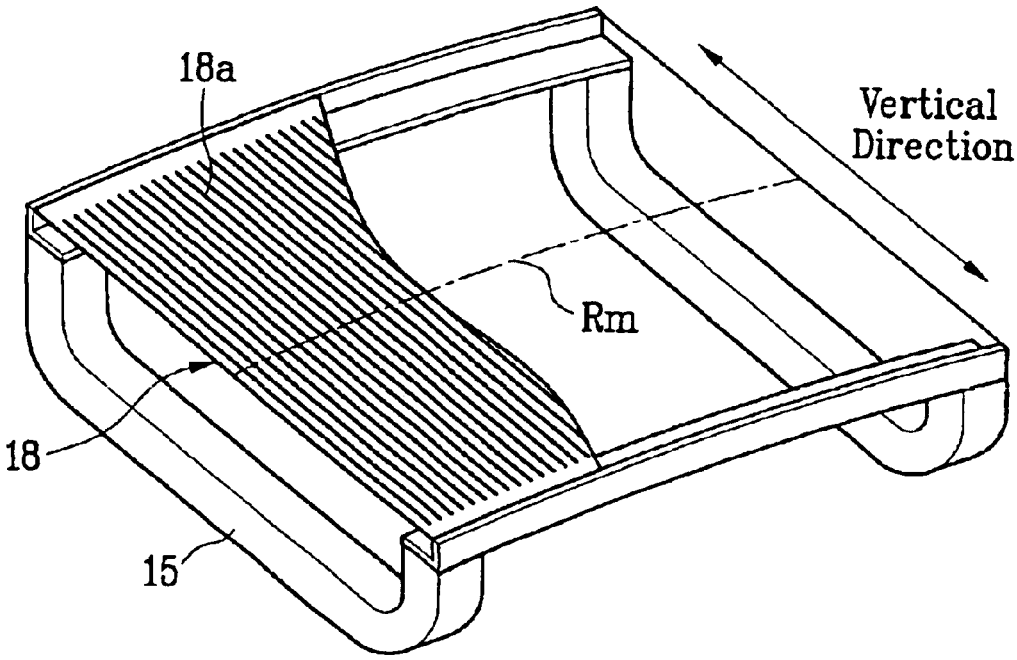
FIG. 2 Related Art
FIG. 2 is perspective view of an assembly of a conventional tension mask and a frame.
Figure 3A:
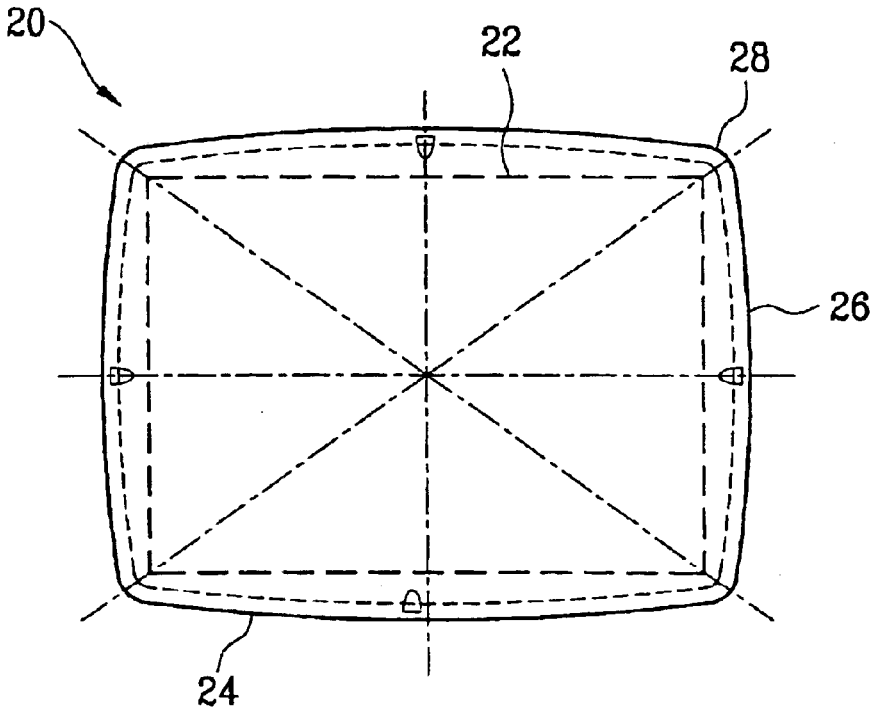
FIG.3A Related Art
FIGS. 3*a* and 3*b* are a top plan and a cross sectional view illustrating the structure of a conventional panel.
Figure 3B:
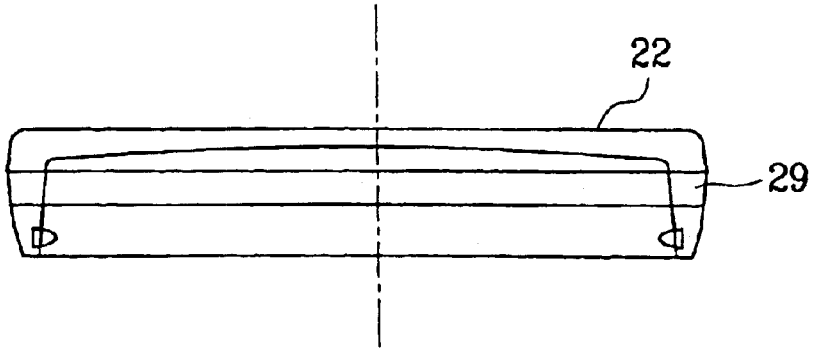
FIG.3B Related Art
Figure 4:
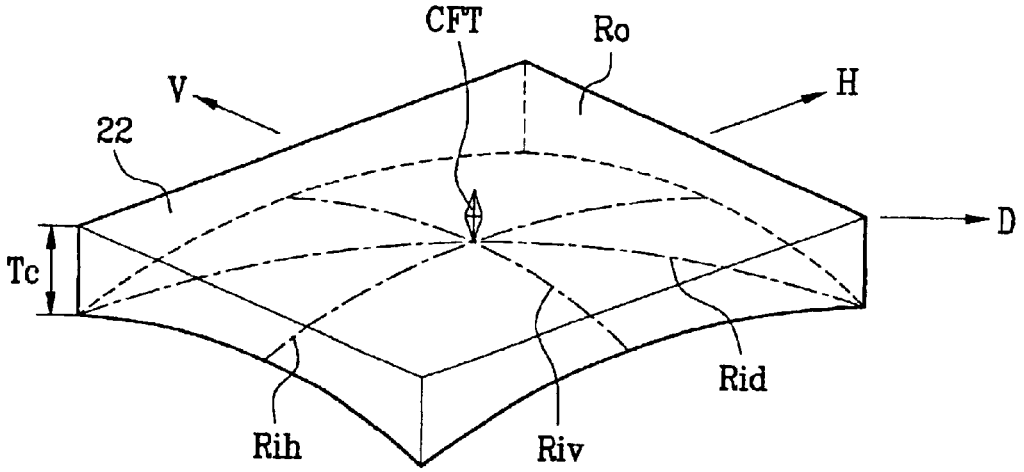
FIG. 4 Related Art
FIG. 4 a perspective view illustrating the construction of an effective surface of a conventional panel.
Figure 5A:
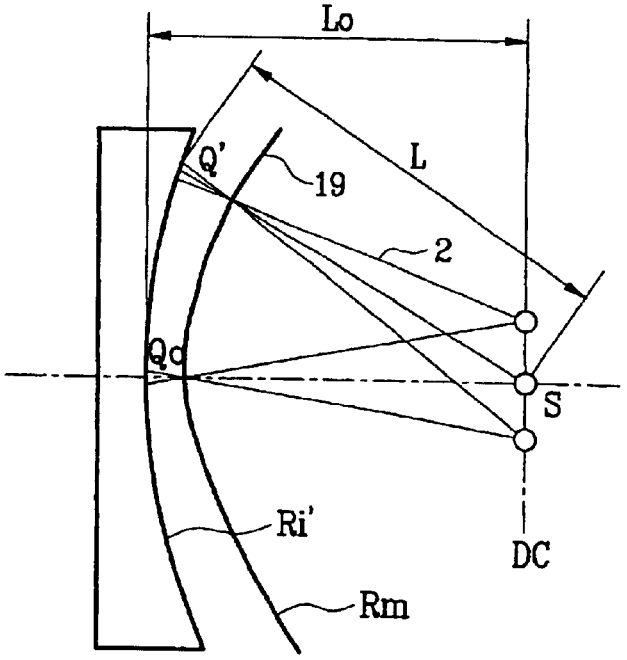
FIG. 5A Related Art
FIG. 5*a* is a view illustrating a geometrical relationship of a conventional formed mask-type flat color cathode ray tube.
Figure 5B:
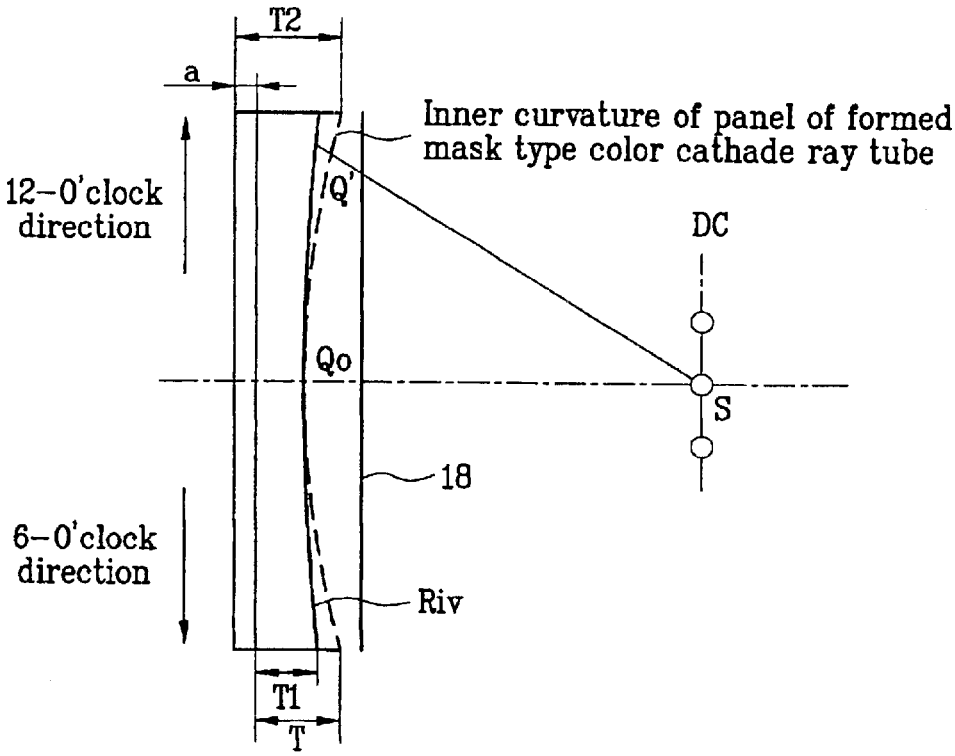
FIG.5B Related Art
FIG. 5*b* is a view illustrating a geometrical relationship between electron beams and a panel and mask with respect to the conventional mask stretching-type flat color cathode ray tube.
Figure 6:
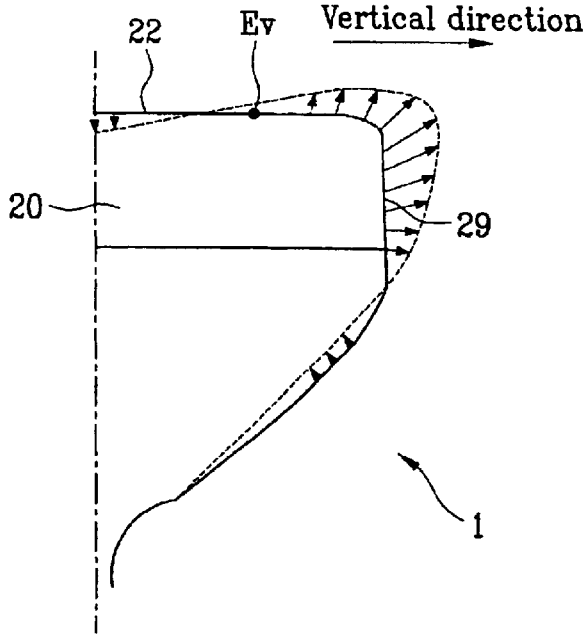
FIG.6 Related Art
FIG. 6 shows distortion of a vacuum envelope when evacuating the vacuum envelope.
Figure 7:
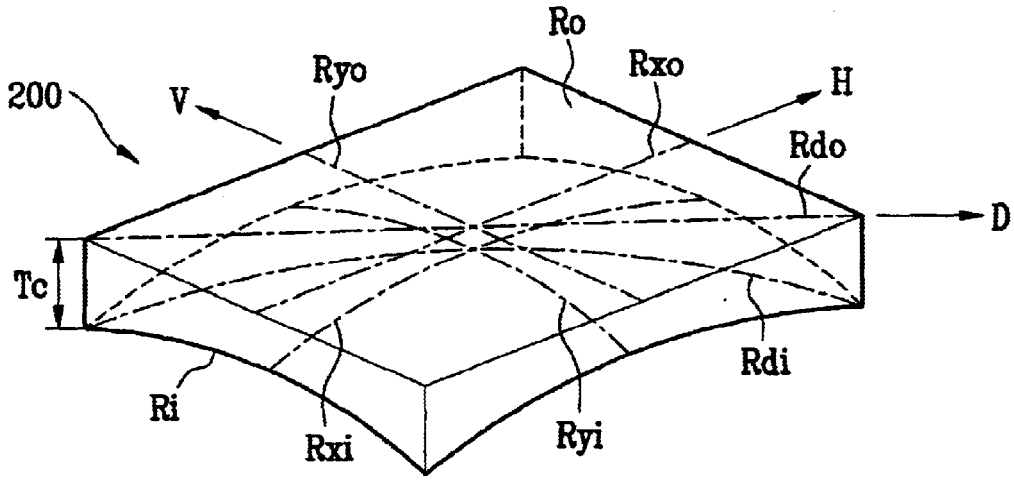
FIG. 7 is a perspective view illustrating an effective surface of a panel for a mask stretching-type color cathode ray tube.

FIGS. 7 and 8 shows one preferred embodiment of a color cathode ray tube according to the present invention.

An outer surface of an effective surface has a large curvature radius Ro when viewing visually. The curvature radius Ro of the outer surface is represented by three components, i.e., horizontal, vertical and diagonal curvatures. Specifically, the curvature radius consists of a curvature radius of a horizontal outer surface (Rxo), a curvature radius of a vertical outer surface (Ryo), and a curvature radius of a diagonal outer surface (Rdo), wherein Rxo, Ryo and Rdo have the same or different curvature radius.

A length Sd of a diagonal effective picture of the outer surface is determined by a size of the cathode ray tube. In order to maintain plane feeling, the plane feeling has the valve Rdo which satisfies a relationship of F>21 if a relationship between the diagonal curvature and the diagonal effective picture is represented by F=Rdo/(Sd H 1.767).

Referring to an inner surface of the panel forming a phosphor screen, a curvature Ri of the inner surface is represented by three components, i.e., horizontal, vertical and diagonal curvatures. Specifically, the curvature radius consists of a curvature radius of a horizontal inner surface (Rxi), a curvature radius of a vertical inner surface (Ryi), and a curvature radius of a diagonal inner surface (Rdi). The outer an dinner curvatures of the panel are spaced apart from each other by a thickness CFT of the panel at the center portion of the panel. A diagonal end of the effective surface of the panel has a thickness Tc, and the inner surface of the panel has a convex curvature, to have a thickness more than the thickness CFT of the center portion. A relationship of CFT and TC has to satisfy a condition of $Tc/CFT \leqq 1.35$.

A relationship of the inner curvature radiuses Rxi, Ryi and Rdi has to satisfy the below condition.

The relationship is satisfied with Rdi>(Ryi or Rxi), and also $0.81 \leqq Ryi/Rdi \leqq 0.99$ and $0.99 \leqq Ryi/Rxi \leqq 1.35$, or the relationship is satisfied with Rdi>Ryi>Rxi, and also $0.81 \leqq Ryi/Rdi \leqq 0.99$ and $0.99 \leqq Ryi/Rxi \leqq 1.35$.

The relationship between the outer and inner curvatures is satisfied with Rdi>(Ryi or Rxi), and the relationship between the vertical outer curvature radius Ryo and the vertical inner curvature radius Ryi is satisfied $0.81 \leqq Ryi/Rdi \leqq 0.11$.

The more a ratio of Ryi/Ryo has a large value, the less an wedge rate becomes to be small.

Geometrical meanings and determining background of a stretching-type color cathode ray tube of the present invention as described will now be described.

In view of structural viewpoint, a major difference between the mask stretching-type color cathode ray tube and the formed mask-type color cathode ray tube is that the vertical curvature radius of the mask is infinite, in other words, there is no almost curvature. Therefore, the wedge rate Tc/CFT indicative of the thickness difference between the thickness CFT of the center portion of the panel and the thickness Tc of a peripheral portion of the effective surface is about 1.3, so that it is small in relation to the wedge rate of the formed mask, 2.0.

In order to reduce arranging difference of an electron beam between the center portion of the panel and the vertical peripheral portions (6 and 12 clock direction) which is caused from the indefinite (i.e., straight line) of the vertical curvature radius of the mask, the vertical inner curvature of the panel has an increased curvature radius (planerize) in relation to the conventional formed mask-type color cathode ray tube.

It is not easy to design the vertical peripheral portion as the weakest portion in the panel. Since a method of increasing the thickness of the outer surface (increase of CFT) such as the prior art causes a secondary problem, the present invention reduces the vertical curvature radius of the inner surface to obtain a dynamic stress characteristic of the panel within a range corresponding to the required beam arrangement.

Figure 9:
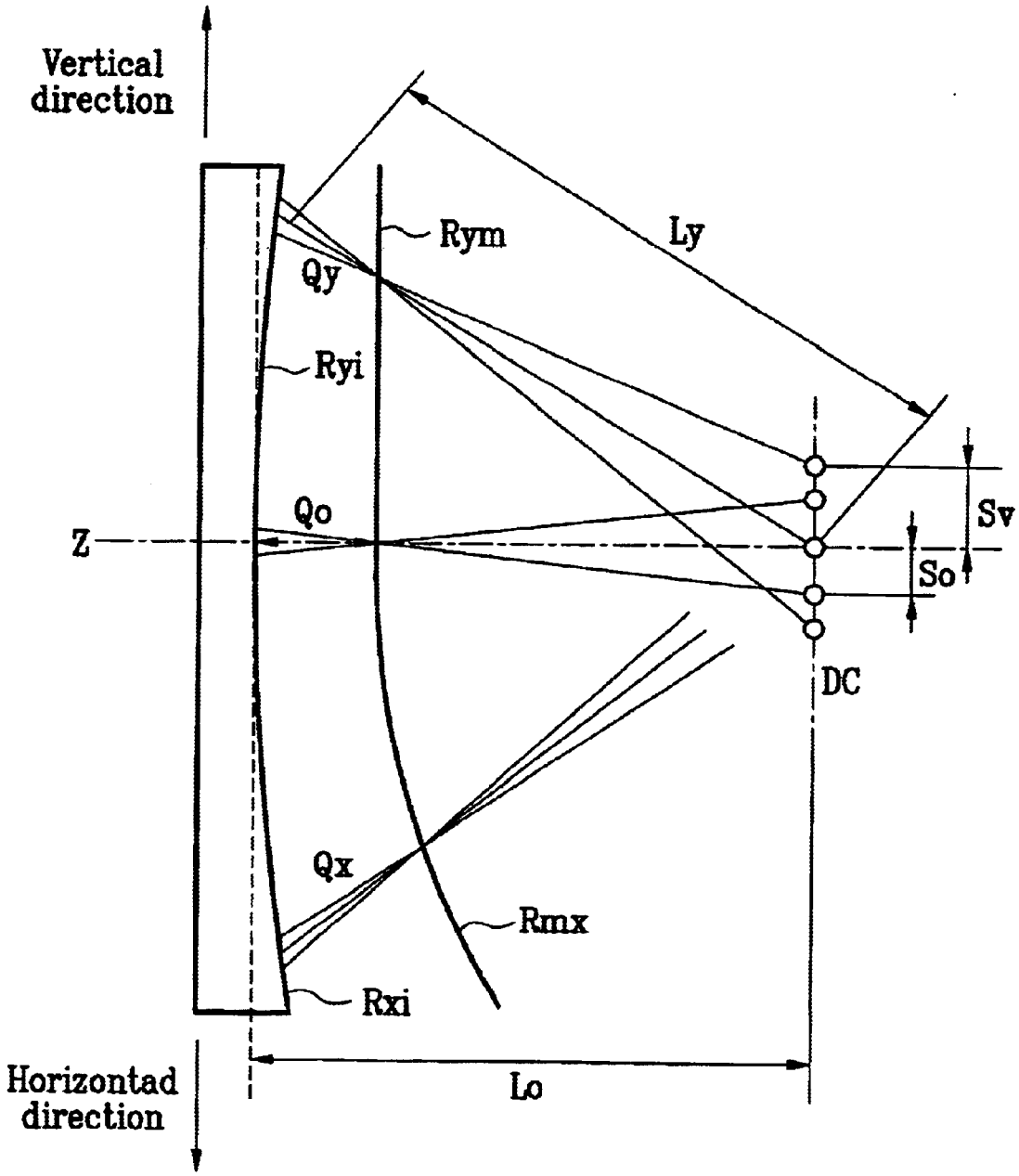
FIG. 9 is a view illustrating a geometrical relationship between electron beams and a panel and mask according to the present invention mask stretching-type flat color cathode ray tube.

FIG. 9 shows a geometrical relationship between the panel, tension mask and electron beam when applying the panel of the present invention. An upper half of FIG. 9 shows deflection of a vertical direction, while a lower half there shows deflection of a horizontal direction.

In case that the electron beam is emitted onto the center portion of the panel, if a distance between a center electron beam (or electron beam of vertical peripheral portion) and a peripheral electron beam is So (or Sy), a distance from a deflection center DC to an inner center portion (or vertical peripheral portion) of the panel is Lo (or Ly), a distance from the center portion (or vertical peripheral portion) of the panel to an tension mask is Qo (or Qy), and a pitch between an aperture and an adjacent aperture of the tension mask is Ph, the beam arrangement GR (or Gry) of the electron beam reached to the center portion (or the vertical peripheral portion of the panel) through the tension mask is represented by as follows:

$$GR \propto \frac{So \times Qo}{Ph \times Lo},\ GRy \propto \frac{Sy \times Qy}{Ph \times Ly} \quad (1)$$

The distance from the defection center DC to the panel is determined in such a way that Lo of a center reference and Ly of a vertical peripheral reference have a shape of Lo>Ly. Accordingly, in order to make GR and Gry of the above equation 1 as 1, the distance between the panel and the tension mask requires a shape of Qo<Qy, but the value Qy is lower than Qo at the vertical peripheral portion, due to that Ryi of the present panel is larger than that of the conventional mask formed mask-type color cathode ray tube. At that case, Gry of the equation 1 is lower than 1. According to a method of compensating the above state, when a deflection unit deflects the vertical peripheral portion, the value Sy is larger than the value So at the deflection center DC.

The deflection unit magnifies a magnetic filed as a barrel shape therein. At present, the development of the deflection unit can allow the value Sy to be magnified to about 10 percentages than the prior art. The value GR of the vertical peripheral portion is the same as the value GR by compensating value Q increasing demand portion Qy−Qo with respective to the increase portion Ly−Lo in the equation 1, using the value S increased within 10% by the deflecting unit.

The 10 percentages increase of the value S causes the value Q to be reduced by 10 percentages. Accordingly, it is possible to bend the inner surface of the panel toward the tension mask by the 10 percentages decrease of the value Q. It is necessary to determine the vertical curvature radius Ryi of the inner surface, in view of a light source floating effect according to a refractive index of the glass and the dynamic stress, and the increase of value S at the vertical peripheral portion of the panel by the deflection unit.

Figure 8A:
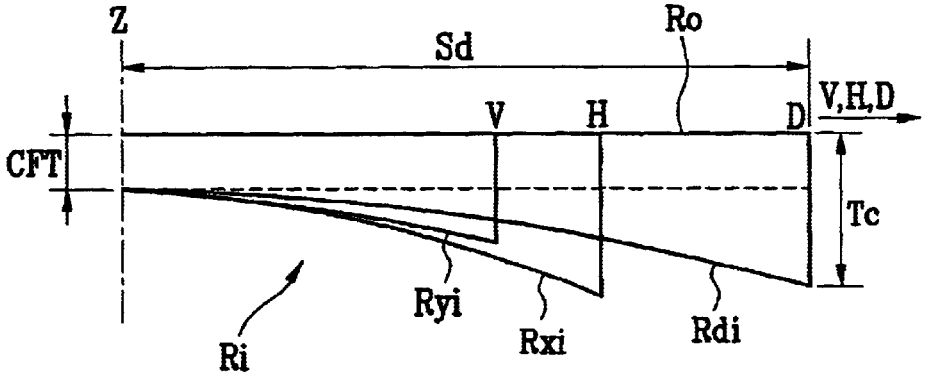
FIGS. 8*a* and 8*b* are cross sectional views of a flat panel to which the present invention is applied.
Figure 8B:
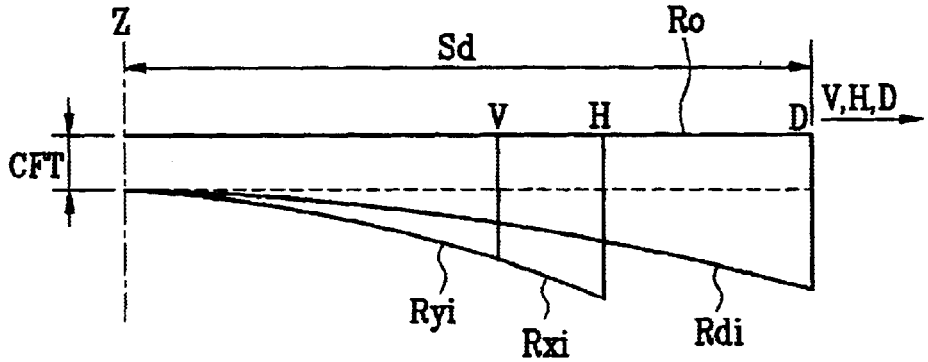

Based on the points to be viewed, a relationship between a next panel structure and an inner curvature radius of each axis is deduced. FIGS. 8*a* and 8*b* show a basic structure of the inner curvature of the present invention, in which FIG. 8*a* shows the relationship of Rdi>Ryi>Rxi (inner curvature radius of diagonal, short and long axes), and FIG. 8*b* shows the relationship of Rdi>(Ryi or Rxi). It is a structure with curvature radius Ryi being reduced relative to the prior art. In order to maintain the beam arrangement, the respective shape is satisfied with that a ratio of the vertical inner curvature to the diagonal inner curvature is $0.81 \leqq Ryi/Rdi \leqq 0.99$, and that a ratio of the vertical inner curvature to the horizontal inner curvature is $0.99 \leqq Ryi/Rxi \leqq 1.35$.

Regarding the relationship between the outer curvature and the inner curvature, a relationship of Rdi>(Ryi or Rxi) is satisfied between the inner curvature radiuses of three axes, and a relationship of $0.08 \leqq Ryi/Ry \leqq 0.11$ is satisfied between the vertical outer curvature radius Ryo and the vertical inner curvature radius Ryi, in view of the stress of vertical peripheral portion of the panel which is a dynamically weak portions.

Considering setting of a range of the respective inner curvature radius ratio and the outer curvature radius ratio, if the ratio Ryi/Rdi of the vertical inner curvature to the diagonal inner curvature is above 1, the radius of curvature is same or the vertical inner curvature has a large value. The panel thickness of the vertical end is remarkably thinner than that of the diagonal axis based on the effective surface. Therefore, when evacuating the vacuum envelope, a stress concentrating phenomenon is produced at the end of the vertical effective surface, so that the ratio is limited below 1. In addition, the lowest limit of the ratio Ryi/Rdi has to be limited. When the deflection unit deflects the vertical peripheral portion, the value Sy at the deflection center DC is determined according to the increase relative to the conventional defection unit. When the maximum increase is set on the basis of 10 percentages, if the ratio Ryi/Rdi is below 0.08 percentages, inconsistency of the electron beam arrangement happens in the panel, thereby producing a grooping phenomenon in which the value GRy becomes to be below 1. Therefore, the ratio has to be maintained above 0.81.

The ratio Ryi/Rxi of the vertical inner curvature Ryi relative to the horizontal inner curvature will now be explained.

The radius of curvature is determined in view of the vacuum stress and the weight of the panel. After the curvature radius (Rdi) of the diagonal inner is set in view of the diagonal curvature radius of the panel and the wedge rate of the panel, the vacuum stress of the vertical end and the arrangement of the electron beam are determined in accordance with a range of Ryi/Rdi, and then the horizontal inner curvature radius is determined. When determining the horizontal inner curvature radius, the horizontal inner curvature radius Rxi is determined in view of the increased weight of the panel. At that time, the vertical curvature radius is determined in view of the horizontal curvature Rxm, but its description will be omitted.

Considering the ratio Ryi/Rxi in the conventional stretching-type color cathode ray tube, the ratio is above 1.4. It is the reason the vertical curvature radius Ryi is reduced. In case of exceeding 1.4, the thickness of the horizontal panel is reduced, thereby causing the vacuum stress of the horizontal peripheral portion to be increased. Accordingly, as the results of comparing the vertical peripheral stress and the vacuum stress of the horizontal peripheral portion, it is necessary to maintain the ratio below 1.35.

In case that the ratio Ryi/Rxi has a small value below 1, the thickness of the horizontal peripheral portion is increased, thereby increasing the weight of the panel. In order to prevent an unnecessary weight from being increased, it is necessary to form the ratio Ryi/Rxi as more than 0.99 in that the horizontal curvature radius is identical to the vertical curvature radius.

The ratio Ryi/Ryo of the vertical inner curvature radius Ryi to the vertical outer curvature radius Ryo is a factor determining the vertical thickness of the panel as well as the center thickness of the panel. The ratio between the minimum vertical outer curvature radius Ryo determined by considering the outer planer feeling of the panel, and the minimum inner curvature radius Ryi determined by considering the arrangement of the electron beam is maintained in a condition of $0.08 \leqq Ryi/Ry \leqq 0.11$. It is efficient in view of the stress and weight.

In case of adopting the panel structure described above, it is possible to locally complement with respect to the vertical peripheral portion of which is the weakest portion of the panel. In contrast that the entire thickness of the outer surface of the panel is increased, the present invention coincides with the ultimately investigation of the flat cathode ray tube such as suppressing the increased weight of the panel and the luminance characteristic reduction of the cathode ray tube according to the increased thickness.

When the present invention is applied to the panel for mask stretching-type color cathode ray tube of 32 voltages and 4:3 aspect ratio, the shape of the panel is improved as follows:

The results are shown in Table 1. The outer curvature radius Ryo of the panel is maintained in 100,000 mm such as the prior art to secure the plane feeing, while the vertical inner curvature radius Ryi is reduced from 12,000 mm of the prior art to 8,7000 mm (about 28 percentages). The horizontal inner curvature radius is increased by 5 percentages relative to the prior art to coincide with the pitch of the tension mask.

Therefore, the structure of the entire curvature radius is satisfied with Rdi (diagonal)>Ryi (vertical)>Rxi (horizontal).

Third, the breakage of the vacuum envelope of the cathode ray tube may be reduced through reduction of the thickness of the panel, during the annealing process using a high temperature of 450 degrees. The breakage at the annealing of the glass panel happens by the thermal stress generated due to the temperature difference between the center portion and surface of the panel or an outer surface of inner surface of the cathode ray tube. Accordingly, if the thickness of the glass panel is thinned, so that the temperature difference is reduce to reduce the thermal stress.

Fourth, the annealing process consists of a raising region with a temperature gradient of 3 to 5° C./min and a descending region with a temperature gradient of 5 to 8° C./min. In case that the temperature gradient is large, the temperature difference between the center portion and outer portion of the glass panel becomes to be large, thereby increasing the stress and then increasing the leakage. In case of reducing the thickness of the panel, the temperature difference is reduced, thereby increasing the speed of annealing process.

TABLE 1

| | Ryi | Rxi | Rdi | Ryo | Ryi/Rdi | Ryi/Rxi | Ryi/Ryo | Curvature Radius |
|---|---|---|---|---|---|---|---|---|
| Present invention | 8,700 | 8,400 | 10,500 | 100,000 | 0.83 | 1.04 | 0.09 | Rdi > Ryi > Rxi |
| Prior art | 12,000 | 8,000 | 10,000 | 100,000 | 1.20 | 1.50 | 0.12 | Ryi > Rdi > Rxi |

The characteristics according to the structure as described above are shown in Table 2.

By reducing the vertical outer curvature radius Ryo of the panel to about 28 percentages, the vertical peripheral portion of which is the weakest portion among the panel is partially complemented. Therefore, comparing to the prior art, the thickness of the center portion of the panel is reduced to 2.5 mm (11.6%), and the thickness of the end of the respective effective surface is reduced to 3.5 mm (12.5%), thereby reducing the weight of the panel to 13 percentages as a whole. The transmittance of the panel related to the luminance characteristic of the cathode ray tube is improved to 12.3 percentages.

In despite of the improvements, the tension stress is reduced to 9.60 Mpa that is below 10 Mpa of limit tension stress required dynamically.

TABLE 2

| | Prior Art | Present invention | Difference | Effects | |
|---|---|---|---|---|---|
| Thickness of center portion of panel (CFT) | 21.5 | 19.0 | 2.5 | Reduce 11.6% | Entire weight reduction: 2.8 kg |
| End of diagonal effective end | 28.0 | 24.5 | 3.5 | Reduce 12.5% | |
| Transmittance of panel (Tc) | 33.7 | 37.9 | 4.1 | Improve 12.3% | |
| Vacuum stress (Mpa) (vertical end) | — | 9.6 | — | Below 10 Mpa of limit tension stress | |

The effects of the present invention will be summarized as follows:

First, the thickness of the entire surface of the effective surface comprising the thickness of the panel, i.e., the thickness (CFT) of the center portion of the panel may be reduced.

Second, due to the reduction of the thickness of the panel, the problematic weight of the cathode ray tube, in particular, a flat cathode ray tube, may be reduced.

Finally, the panel for the flat cathode ray tube has an increased thickness of the panel relative to the cathode ray tube having a curvature. In particular, in case of the stretching-type color cathode ray tube having a reduced wedge rate, the increase of the thickness is above 30%, the reduction of the light transmittance of the panel causes the luminance to be reduced. Accordingly, since the reduction of the thickness of the panel is requested, much more effect is expected when the present invention is applied.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A flat color cathode ray tube including a vacuum envelope composed of a panel, a funnel, and a neck, the panel having a generally flat outer surface and a convex inner surface having a curvature with respect to an axis of the cathode ray tube, the inner surface having an effective surface on which a phosphor screen is formed, a grill or stripe-type mask being opposed to the inner surface of the panel and extended in a vertical direction, wherein in an equation $F=Rdo/(Sd\times1.767)$, conditions of $F>21$, $Tc/CFT\leqq1.35$, and Rdi>(Ryi or Rxi) are satisfied, where Sd is a length of a diagonal effective picture of the panel, Rdo is a curvature radius of a diagonal outer surface, Ryo is a curvature radius of a vertical outer surface, Rxi, Ryi and Rdi are a horizontal, vertical and diagonal curvature radius, respectively, CFT is a thickness of a center portion, Tc is a thickness of a diagonal end of the effective surface, F is a planarizing rate of the outer curvature.

2. The cathode ray tube as claimed in claim 1, wherein a relationship of $0.81\leqq Ryi/Rdi\leqq0.99$ is satisfied between the inner curvature radius of the respective axis.

3. The cathode ray tube as claimed in claim 1, wherein a relationship of $0.99 \leqq Ryi/Rxi \leqq 1.359$ is satisfied between the inner curvature radius of the respective axis.

4. The cathode ray tube as claimed in claim 1, wherein structure of the inner curvature radius of the panel is satisfied with $Rdi > Ryi > Rxi$.

5. The cathode ray tube as claimed in claim 1, wherein a relationship of $0.81 \leqq Ryi/Rdi \leqq 0.99$ and $0.99 \leqq Ryi/Rxi \leqq 1.35$ is satisfied between the inner curvature radius of the respective axis.

6. The cathode ray tube as claimed in any one of claims 1 to 5, wherein a relationship of $0.08 \leqq Ryi/Ryo \leqq 0.11$ is satisfied between the vertical outer curvature radius and the vertical inner curvature radius.

7. The cathode ray tube as claimed in claim 2 or claim 3, wherein a relationship of $0.82 \leqq Ryi/Rdi \leqq 0.95$ is satisfied between the vertical inner curvature radius Ryi and the diagonal inner curvature radius Rdi, or a relationship of $1.00 \leqq Ryi/Rxi \leqq 1.30$ is satisfied between the vertical inner curvature radius Ryi and the horizontal inner curvature radius Rxi.

* * * * *